US010124240B2

(12) United States Patent
Parvanta

(10) Patent No.: US 10,124,240 B2
(45) Date of Patent: Nov. 13, 2018

(54) GAME TABLE TELEVISION AND PROJECTOR SYSTEM, AND METHOD FOR SAME

(76) Inventor: Lydia Parvanta, Smyrna, GA (US)

( * ) Notice: Subject to any disclaimer, the term of this patent is extended or adjusted under 35 U.S.C. 154(b) by 835 days.

(21) Appl. No.: 11/598,856

(22) Filed: Nov. 14, 2006

(65) Prior Publication Data

US 2008/0111310 A1 May 15, 2008

(51) Int. Cl.

| | |
|---|---|
| ***A63F 9/00*** | (2006.01) |
| ***A63D 15/20*** | (2006.01) |
| ***A63D 15/00*** | (2006.01) |
| *A63F 7/36* | (2006.01) |
| *A63F 9/24* | (2006.01) |
| *A63F 11/00* | (2006.01) |

(52) U.S. Cl.

CPC ..... *A63D 15/20* (2013.01); *A63D 15/00* (2013.01); *A63F 7/36* (2013.01); *A63F 9/001* (2013.01); *A63F 2007/3674* (2013.01); *A63F 2009/2463* (2013.01); *A63F 2011/0097* (2013.01); *A63F 2250/64* (2013.01)

(58) Field of Classification Search

CPC ..... A63F 9/00
USPC ..... 273/309; 463/34
See application file for complete search history.

(56) References Cited

U.S. PATENT DOCUMENTS 1,540,316 A * 6/1925 Clement ..... A63D 15/04 473/11
3,077,814 A * 2/1963 Kerkow ..... G03B 15/12 352/89
4,232,335 A * 11/1980 Nakagawa ..... G01B 11/02 346/33 MC
4,521,017 A * 6/1985 McCready ..... A63B 67/04 473/459
4,707,746 A * 11/1987 Nishikawa ..... 348/787
5,026,053 A 6/1991 Paterson et al.
5,112,060 A * 5/1992 Jones ..... A63F 3/00157 273/148 R
5,117,221 A * 5/1992 Mishica, Jr. ..... G08B 13/183 250/221
5,435,557 A * 7/1995 Coffey ..... A63F 13/02 273/DIG. 30
5,618,045 A * 4/1997 Kagan ..... A63F 13/12 463/40
5,658,202 A * 8/1997 McGovern ..... A63D 15/00 473/18
5,775,993 A * 7/1998 Fentz ..... G07F 17/3262 463/17
5,794,932 A * 8/1998 Gastone ..... A63F 3/00214 273/241
D416,948 S * 11/1999 Soga ..... D21/330
(Continued)

FOREIGN PATENT DOCUMENTS

EP 1428561 A1 6/2004
JP 2004159964 A2 6/2004
(Continued)

*Primary Examiner* — John E Simms, Jr.
*Assistant Examiner* — Dolores Collins
(74) *Attorney, Agent, or Firm* — The Iwashko Law Firm, PLLC; Lev Ivan Gabriel Iwashko

(57) ABSTRACT

A game table television and method that allows for more frequent or continuous use of the game table by enabling additional and/or simultaneous use as a television, which may be conveniently enjoyed and/or controlled by the participants and/or spectators of the table game.

13 Claims, 3 Drawing Sheets

(56) References Cited

U.S. PATENT DOCUMENTS 6,036,189 A * 3/2000 Gomez et al. ..... 273/118 R
6,082,736 A * 7/2000 Barlow ..... A63B 67/04 273/108.1
6,093,101 A * 7/2000 Mourad ..... 463/13
6,179,426 B1 1/2001 Rodriguez, Jr. et al.
6,488,583 B1 * 12/2002 Jones ..... A63F 13/04 273/459
6,494,784 B1 * 12/2002 Matsuyama et al. ..... 463/6
6,514,145 B1 * 2/2003 Kawabata et al. ..... 463/46
D472,937 S * 4/2003 Chang ..... D21/333
6,609,465 B2 * 8/2003 Kolavo ..... A47B 21/0073 108/50.01
6,620,043 B1 * 9/2003 Haseltine et al. ..... 463/7
6,688,597 B2 * 2/2004 Jones ..... 273/274
6,726,564 B2 * 4/2004 Hogan et al. ..... 463/25
6,753,879 B1 * 6/2004 Deleeuw ..... 345/629
6,761,634 B1 * 7/2004 Peterson ..... A63F 3/00643 273/236
6,835,133 B2 * 12/2004 Baerlocher et al. ..... 463/20
6,848,994 B1 * 2/2005 Knust et al. ..... 463/25
6,887,157 B2 * 5/2005 LeMay et al. ..... 463/32
6,921,337 B1 * 7/2005 Kennedy et al. ..... 463/42
6,982,649 B2 * 1/2006 Blum ..... A47L 23/22 340/572.1
7,108,606 B1 * 9/2006 Luciano et al. ..... 463/46
7,156,745 B1 * 1/2007 Fahmie ..... A63D 15/04 108/13
7,160,187 B2 * 1/2007 Loose ..... G07F 17/3202 273/274
7,195,242 B2 * 3/2007 Terminel et al. ..... 273/274
7,306,516 B2 * 12/2007 Iosilevsky ..... G07F 17/3211 463/13
7,306,521 B2 * 12/2007 Toyoda ..... 463/20
7,367,884 B2 * 5/2008 Breeding et al. ..... 463/25
7,416,118 B2 * 8/2008 Throckmorton et al. .... 235/383
7,566,274 B2 * 7/2009 Johnson ..... G07F 17/3262 273/309
7,575,512 B2 * 8/2009 Kennedy ..... G07F 17/32 463/12
7,690,996 B2 * 4/2010 Iddings ..... G07F 17/32 463/10
7,695,364 B2 * 4/2010 Okada ..... G07F 17/32 273/138.1
8,292,733 B2 * 10/2012 Crawford ..... A63D 5/04 273/309
8,347,790 B1 * 1/2013 Maiers ..... A63F 1/067 108/25
8,376,842 B2 * 2/2013 Rasmussen ..... G07F 17/3218 463/16
8,821,239 B1 * 9/2014 Chun ..... A63F 1/067 463/11
8,890,962 B2 * 11/2014 Proca ..... H04N 5/23267 348/208.2
9,566,500 B2 * 2/2017 Chun ..... A63F 1/067
2002/0077170 A1 * 6/2002 Johnson ..... G07F 17/32 463/16
2003/0102627 A1 * 6/2003 Shinn ..... A47B 9/00 273/309
2004/0070149 A1 4/2004 Lipscomb et al.
2004/0135316 A1 * 7/2004 Lipscomb ..... G07F 17/32 273/274
2005/0093241 A1 5/2005 Lipscomb et al.
2005/0153775 A1 * 7/2005 Griswold ..... G07F 17/3211 463/30
2005/0185825 A1 8/2005 Hoshino et al.
2005/0192094 A1 9/2005 Okada et al.
2007/0219006 A1 * 9/2007 Zajac ..... A63D 15/04 473/4
2007/0243929 A1 * 10/2007 Skotarczak ..... 463/31
2007/0249421 A1 * 10/2007 White ..... A63F 13/08 463/40
2008/0039175 A1 * 2/2008 Tessmer ..... G07F 17/3262 463/20
2008/0204869 A1 * 8/2008 Stewart ..... G03B 21/56 359/460
2008/0250985 A1 * 10/2008 Hall ..... A47B 21/007 108/50.11
2008/0287200 A1 * 11/2008 Yang ..... G07F 17/322 463/46
2009/0124383 A1 * 5/2009 Gadda ..... G07F 17/32 463/36
2012/0238373 A1 * 9/2012 Chen ..... A63D 15/04 473/14

FOREIGN PATENT DOCUMENTS

JP 2005334336 A2 12/2005
JP 2006043017 A2 2/2006
WO WO 1990/05005 A1 5/1990
WO WO 2000/16863 A1 3/2000
WO WO 2004/026416 A2 4/2004

* cited by examiner

GAME TABLE TELEVISION AND PROJECTOR SYSTEM, AND METHOD FOR SAME

BACKGROUND OF THE INVENTION

Technical Field

The present invention relates generally to games or amusement devices, and more specifically to a game table system including a television screen or monitor and method for same.

Description of Related Art

Numerous games played either for recreation, or as a profession, involve the use of a game table. Such a game table is often specifically designed for a particular game or a particular type of game. One example of such a game type, and associated table, is billiards (or pool). A pool table typically consists of a level planar surface bounded around its perimeter by elastic or semi-elastic bumpers and intervally spaced pockets. Pool table dimensions vary, but most are large: usually being or exceeding 7 feet in length. When not in use for playing pool, the pool table constitutes a large unused space in whatever room it is placed. To address the problem of wasted space, conversions have been developed that allow the pool table to serve another purpose, such as to provide a game surface for another game, such as table tennis. Thus, even when the table is not used for playing pool, it may be used for another game, thereby allowing increased utilization of the space occupied by the pool table. Unfortunately, such modifications to convert a game table for a first game to a game table for a second game fail to greatly expand the uses of the game table, and the table may often go unused, during which time it continues to waste a large amount of space in the room.

Additionally, many game tables are found in business establishments, such as pool halls, game rooms, or bars. In many such establishments, different forms of entertainment are provided to customers simultaneously in order to provide a more enjoyable experience for the customer. For example, music, television, or both may be played as background entertainment for participants of a table game for their enjoyment either while playing or while they are waiting to play. Unfortunately, however, the players of the game must usually remain in close proximity to the game table, and are, thus, usually not positioned to take full advantage of the additional forms of entertainment by selecting different programs or songs, as desired, which may be different than those desired by others in the establishment.

It is desirable, therefore, to provide a game table that allows for more frequent or continuous use of the game table by enabling additional and/or simultaneous uses for various different forms of entertainment which may be conveniently enjoyed and/or controlled by the participants and/or spectators of the table game.

BRIEF SUMMARY OF THE INVENTION

Briefly described, in a preferred embodiment, the present invention overcomes the above-mentioned disadvantages and meets the recognized need for such a device by providing a game table comprising a table, a game surface on the table on which a table game may be played, and a television, wherein at least a portion of the television is integrally incorporated in the game table.

According to its major aspects and broadly stated, the present invention in its preferred form is a game table including at least a portion of a television integrally incorporated therewith.

According to another aspect of the preferred embodiment, the game surface serves as the screen.

According to another aspect of the preferred embodiment, the screen is disposed proximate the game surface.

According to another aspect of the preferred embodiment, the screen is movable, removable, adjustable, and/or retractable.

According to another aspect of the preferred embodiment, the television is a front projection, rear projection, flat panel, LCD, plasma, CRT, and/or DLP television.

According to another embodiment of the invention, the present invention overcomes the above-mentioned disadvantages and meets the recognized need for such a method by providing a method of displaying a television image comprising the steps of forming a television image and displaying the television image on a screen, the screen being selected from the group comprised of a screen integrally formed with at least a portion of a game table and a screen operably attached to at least a portion of a game table.

According to another aspect of the present invention, the image is projected onto a front of the screen.

According to another aspect of the present invention, the image is projected onto a back of the screen.

According to another aspect of the present invention, the image is projected onto the game surface.

Accordingly, a feature and advantage of the present invention is its ability to provide an additional or alternative entertainment to a game table.

Another feature and advantage of the present invention is its ability to allow participants and/or spectators of a table game to watch television on or proximate to the game table.

Another feature and advantage of the present invention is its ability to increase the usefulness and/or enjoyment of a game table.

These and other objects, features, and advantages of the invention will become more apparent to those ordinarily skilled in the art after reading the following Detailed Description and Claims in light of the accompanying drawing Figures.

BRIEF DESCRIPTION OF THE DRAWINGS

Accordingly, the present invention will be understood best through consideration of, and reference to, the following Figures, viewed in conjunction with the Detailed Description of the present invention referring thereto, in which like reference numbers throughout the various Figures designate like structure and in which.

It is to be noted that the drawings presented are intended solely for the purpose of illustration and that they are, therefore, neither desired nor intended to limit the invention to any or all of the exact details shown, except insofar as they may be deemed essential to the claimed invention.

DETAILED DESCRIPTION OF THE INVENTION

In describing preferred embodiments of the present invention illustrated in the Figures, specific terminology is employed for the sake of clarity. The invention, however, is not intended to be limited to such specific terminology, and it will be understood that each specific element includes all technical equivalents that operate in a similar manner to accomplish a similar purpose.

Figure 1:
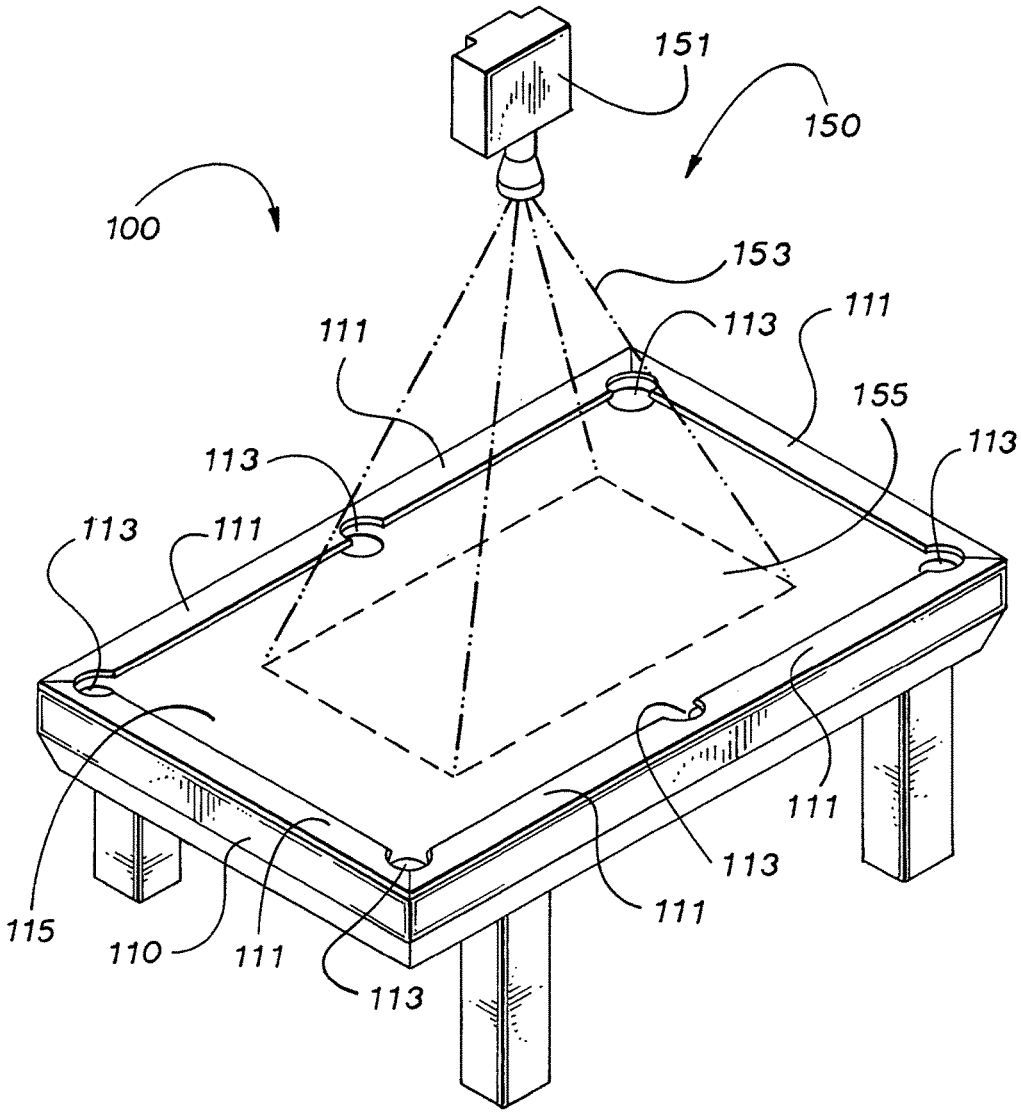
FIG. 1 is a perspective view of a preferred embodiment of the present invention.

Now referring to the figures, in that form of the preferred embodiment of the present invention chosen for purposes of illustration, FIG. 1 shows game table 100 preferably in the form of pool table 110, and preferably including rails 111 and pockets 113 disposed around a perimeter of game surface 115. Game table 100 preferably further includes television system 150 comprising television projector 151, projected television image 153 (shown in dashed lines), and screen 155. Preferably, screen 155 is formed of at least a portion of game surface 115 and the projected television image is visible on the portion of game surface 115 comprising screen 155. Television system 150, and/or pool table 110 may optionally include speakers to provide sound and/or controls to allow adjustment of television image 153, such as changing a channel, image size, volume, picture-in-picture, contrast, brightness, hue, or other television setting.

In use, television projector 151 is preferably mounted in a position above game table 100 such that game surface 115 acts as screen 155 of television system 150 and projected television image 153 is clearly displayed in a prominent position on game surface 115. The size and position of screen 155 may be adjusted relative to game surface 115 as desired or as necessary depending on the game being played and/or the number of television projectors or images included in television system 150, among other factors. Players may optionally play a table game on game surface 115 while television images 153 are displayed on screen 155, and the players and/or spectators may watch television images 153 for their enjoyment.

Figure 2:
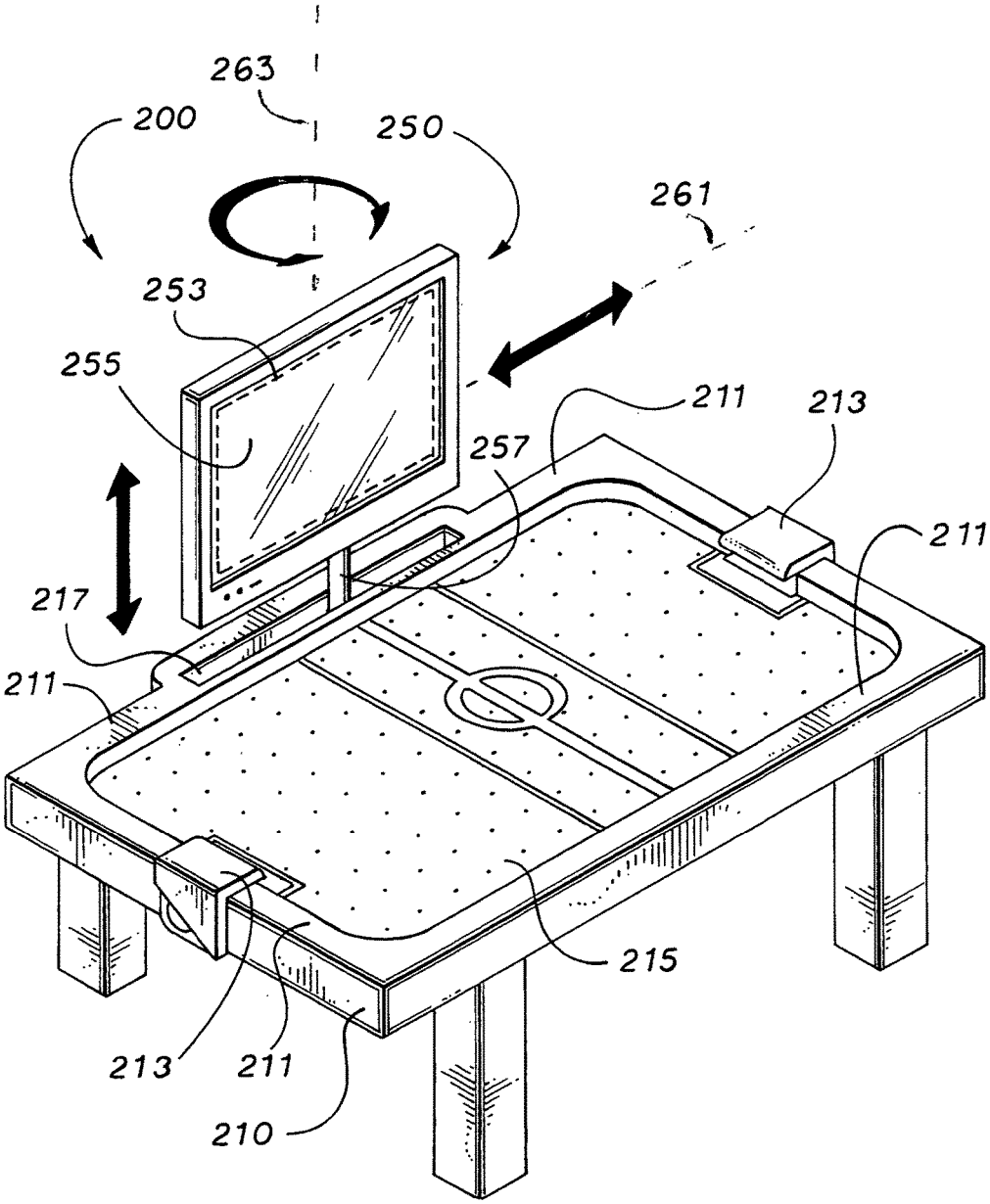
FIG. 2 is a perspective view of another embodiment of the present invention.

Now referring to FIG. 2, game table 200, in the form of an air hockey table, preferably includes table 210, rails 211, goals 213, and game surface 215. Game table 200 preferably further includes television system 250 mounted to rail 211 by mounting structure 257. Television system 250 preferably includes screen 255 for displaying television image 253 such that it is visible by players or spectators of a table game played on game surface 215. Optionally, television system 250, or at least screen 255, is adjustable in a direction along or about axes 261, and 263 to provide for improved viewing of television image 253. Television system 250 may further optionally retract at least partially within opening 217 for storage or for protection, such as when moving game table 200. Preferably, such adjustment, movement, rotation, and/or retraction of television system 250, or at least screen 255, is accomplished by adjustment of mounting structure 257, which may include ball and socket joints, hinges, flexible members, track and carriage systems, pneumatic or hydraulic members, telescoping members, or other structure to accomplish such adjustment.

As will be understood by one skilled in the art, television system 250 may be any conventional television system including front projection, rear projection, flat panel, LCD, plasma, CRT, and/or DLP, or other televisions. Preferably, television system 250 comprises an LCD or plasma flat panel television. Alternatively, however, television 250 may optionally be a projection television with a projector (not shown) disposed within a housing together with screen 255 or with a projector mounted remotely from screen 255, as shown in FIG. 1. As will be further understood by one skilled in the art, television system 250 may optionally include a protective cover over screen 255 and/or over other elements thereof to protect such screen or other elements from damage.

Figure 3:
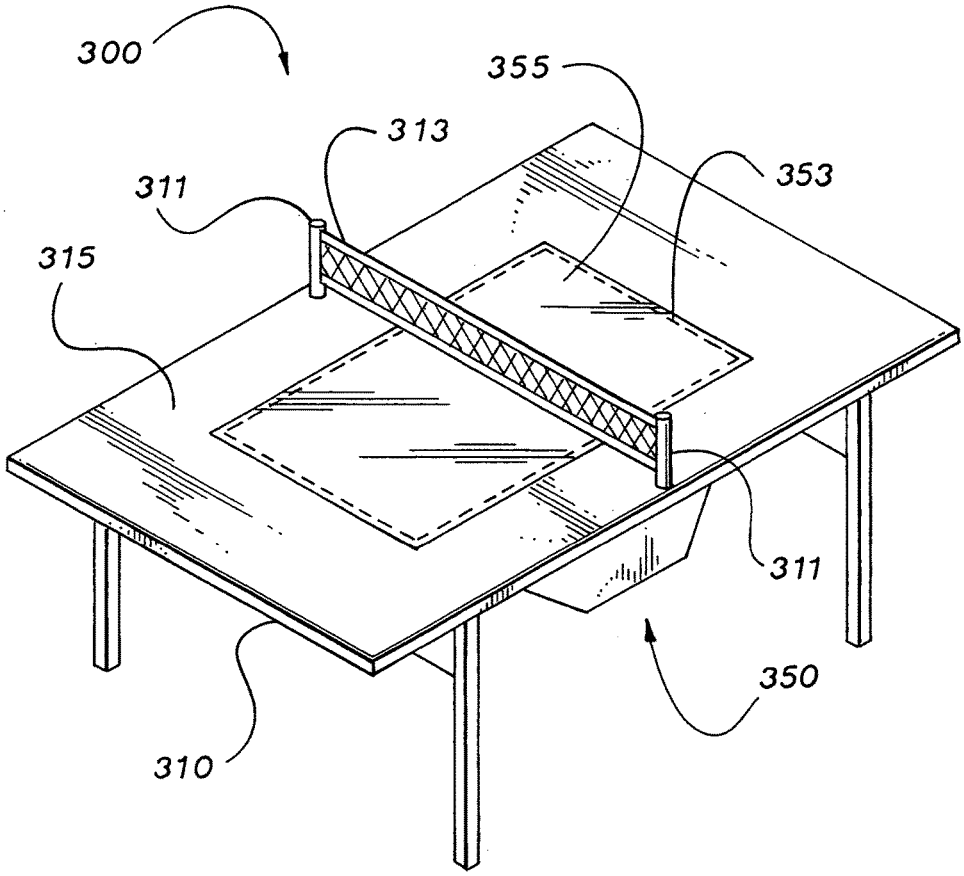
FIG. 3 is a perspective view of another embodiment of the present invention.

Now referring to FIG. 3, game table 300, in the form of a table tennis table, preferably includes table 310, posts 311, net 313, and game surface 315. Game table 300, preferably further includes television system 350 mounted to table 310 such that screen 355 is visible from above game surface 315. Optionally, screen 355 may be mounted flush with game surface 315, and the upper surface of screen 355 may function as game surface 315, or, alternatively, a transparent protective member may serve as game surface 315 in the area above screen 355, such that according to either alternative, television image 353 displayed on screen 355 is visible to players and/or spectators of a game played on game surface 315. Television system 350 preferably comprises a rear projection television or a CRT television, and is preferably securely mounted to table 310. In another embodiments, however, television, system 350 may optionally be a any conventional television system including front projection, rear projection, flat panel, LCD, plasma, CRT, DLP, and/or other television.

Having thus described the exemplary embodiments of the present invention, it should be noted by those skilled in the art that these disclosures are exemplary only and that various other alternatives, adaptations, and modifications may be made without departing from the scope and spirit of the present invention. Accordingly, the present invention is not limited to the specific embodiments as described and illustrated herein, but is only limited by the following claims.

What is claimed is at least:

1. A game table, comprising:

a body having a predetermined structure corresponding to specifications of at least one table game, such that the at least one table game is not playable by at least one user without the predetermined structure;

a surface on a top portion of the body upon which the at least one table game is playable by at the least one user, such that the surface has specific configurations corresponding to the at least one table game, such that the at least one table game is not playable by the at least one user without the specific configurations of the surface; and a television system to display moving images not associated with the at least one table game on the surface such that the at least one table game continues to be playable by the least one user while the moving images not associated with the at least one table game are displayed on the surface, such that the moving images displayed on the surface are associated with a video game playable by another user while the at least one user plays the at least one table game on the surface, wherein the structure of the body includes at least one of a pool table, a billiards table, a table-tennis table, a candlestick bowling table, a shuffleboard table, a pinball machine, a skeeball game, a basketball game, a football game, an air-hockey table, a bubble-hockey table, and a foosball table.

2. The game table of claim 1, wherein the television system comprises:

a projector to project the images onto the surface;

speakers to provide sound corresponding to the projected images; and a plurality of controls to control the television system.

3. The game table of claim 2, wherein the controls allow the at least one user to change at least one of a channel of the television system, a size of the projected images, a contrast of the projected images, a brightness of the projected images, a hue of the projected images, and a volume of the sound.

4. The game table of claim 1, wherein the television system comprises:

a screen embedded within the surface to display the images;

speakers to provide sound corresponding to the displayed images; and a plurality of controls to control the television system.

5. The game table of claim 1, wherein the television system comprises:

a screen mounted to a side of the body to display the images;

speakers to provide sound corresponding to the displayed images; and a plurality of controls to control the television system.

6. The game table of claim 1, wherein the images correspond to a video game being played by at least another user while the at least one table game is being played by the at least one user.

7. The game table of claim 1, wherein the images are viewable by the at least one user from all sides of the game table.

8. The game table of claim 1, wherein the images displayed on the surface correspond to a television program viewable by at least another user while simultaneously allowing the at least one user to play the at least one table game.

9. The game table of claim 1, wherein the images displayed on the surface correspond to another table game playable by the at least one user.

10. The game table of claim 9, wherein the structure of the body corresponds to specifications of a first table game different from the another table game.

11. A game table, comprising:

a body having a structure corresponding to specifications of a pool table;

a surface on a top portion of the body upon which a table game of pool is playable by at least one user, the surface comprising felt and holes in corner portions thereof; and a television system to display moving images not associated with the table game of pool such that the table game of pool continues to be playable by the at least one user while the moving images not associated with the table game of pool are displayed on the surface such that the moving images displayed on the surface are associated with a video game playable by another user while the at least one user plays the table game of pool on the surface.

12. The game table of claim 11, further comprising:

a second surface on a bottom portion of the body comprising air vents to allow a hockey puck glide thereupon, and slots at opposite ends of the second surface to allow the hockey puck to be disposed therein, wherein the body is flippable to allow the second surface to be utilized by the at least one user to play a table hockey game thereupon while the television system displays the images on the second surface.

13. A game table, comprising:

a body having a structure corresponding to specifications of a ping pong table;

a surface on a top portion of the body upon which a table game of ping pong is playable by at least one user, the surface comprising a net disposed thereupon; and a television system to display images not associated with the table game of ping pong such that the table game of ping pong continues to be playable by the at least one user while the images not associated with the table game of ping pong are displayed on the surface, such that the moving images displayed on the surface are associated with a video game playable by another user while the at least one user plays the table game of ping pong on the surface.

* * * * *